US008251808B2

(12) United States Patent
Young et al.

(10) Patent No.: US 8,251,808 B2
(45) Date of Patent: Aug. 28, 2012

(54) GAME TRANSACTION MODULE INTERFACE TO SINGLE PORT PRINTER

(75) Inventors: J Scott Young, Henderson, NV (US); Vijay Kompella, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 524 days.

(21) Appl. No.: 12/112,928

(22) Filed: Apr. 30, 2008

(65) Prior Publication Data

US 2009/0275394 A1 Nov. 5, 2009

(51) Int. Cl.
*A63F 9/24* (2006.01)

(52) U.S. Cl. ..... 463/29; 463/31; 463/47; 705/14.12

(58) Field of Classification Search ..... None
See application file for complete search history.

(56) References Cited

U.S. PATENT DOCUMENTS

| | | | | |
|---|---|---|---|---|
| 3,751,041 | A | 8/1973 | Seifert | 273/149 P |
| 3,787,660 | A | 1/1974 | Meyers et al. | 235/61.9 R |
| 3,814,436 | A | 6/1974 | Boren | 273/149 P |
| 4,108,361 | A | 8/1978 | Krause | 235/375 |
| 4,135,663 | A | 1/1979 | Nojiri et al. | 235/463 |
| 4,244,582 | A | 1/1981 | Raees et al. | 273/293 |
| 4,339,798 | A | 7/1982 | Hedges et al. | 364/412 |
| 4,373,726 | A | 2/1983 | Churchill et al. | 273/138 A |
| 4,534,562 | A | 8/1985 | Cuff et al. | 273/149 P |
| 4,636,846 | A | 1/1987 | Villarreal | 358/100 |
| 4,662,637 | A | 5/1987 | Pfeiffer | 273/149 P |
| 4,667,959 | A | 5/1987 | Pfeiffer et al. | 273/149 R |
| 4,693,480 | A | 9/1987 | Smith | 273/296 |
| 4,725,079 | A | 2/1988 | Koza et al. | 283/73 |
| 4,802,218 | A | 1/1989 | Wright et al. | 380/23 |
| 4,832,341 | A | 5/1989 | Muller et al. | 273/139 |
| 4,885,700 | A | 12/1989 | Kondziolka et al. | 364/519 |
| 4,889,367 | A | 12/1989 | Miller | 283/88 |
| 4,951,950 | A | 8/1990 | Normand et al. | 273/149 P |
| 4,995,615 | A | 2/1991 | Cheng | 273/292 |
| 5,053,612 | A | 10/1991 | Pielemeier et al. | 235/462 |
| 5,067,713 | A | 11/1991 | Soules et al. | 273/149 P |
| 5,110,134 | A | 5/1992 | Laughlin et al. | 273/293 |
| 5,121,921 | A | 6/1992 | Friedman et al. | 273/149 P |
| 5,156,397 | A | 10/1992 | Valenza, Jr. | 273/138 A |
| 5,179,517 | A | 1/1993 | Sarbin et al. | 364/410 |

(Continued)

FOREIGN PATENT DOCUMENTS

DE 3807 127 A1 9/1989

(Continued)

OTHER PUBLICATIONS

Bally Technologies, Inc., iVIEW, http://ballytech.com/systems/product.cfm?id=9, download date Nov. 6, 2007, 2 pages.

(Continued)

*Primary Examiner* — Masud Ahmed
(74) *Attorney, Agent, or Firm* — Seed IP Law Group PLLC

(57) ABSTRACT

A gaming device includes a game module for presenting instances of a game title and a game transaction module for interfacing with a system controller of a game entertainment center. The gaming device further includes a printer for printing various items such as tickets, coupons, vouchers, and other promotional material. The gaming device further includes a printer manager for arbitrating print job conflicts.

12 Claims, 6 Drawing Sheets

U.S. PATENT DOCUMENTS 5,199,710 A 4/1993 Lamle ..... 273/149 R
5,216,234 A 6/1993 Bell ..... 235/494
5,259,907 A 11/1993 Soules et al. ..... 156/277
5,265,874 A 11/1993 Dickinson et al. ..... 273/138 A
5,273,281 A 12/1993 Lovell ..... 273/138 R
5,283,422 A 2/1994 Storch et al. ..... 235/375
5,319,181 A 6/1994 Shellhammer et al. ..... 235/462
5,343,028 A 8/1994 Figarella et al. ..... 235/462
5,397,133 A 3/1995 Penzias ..... 273/439
5,487,544 A 1/1996 Clapper, Jr. ..... 273/138 A
5,493,613 A 2/1996 Denno et al. ..... 380/24
5,505,461 A 4/1996 Bell et al. ..... 273/433
5,518,249 A 5/1996 Sines et al. ..... 273/304
5,548,110 A 8/1996 Storch et al. ..... 235/472
5,559,312 A 9/1996 Lucero ..... 235/380
5,595,538 A 1/1997 Haste, III ..... 463/17
5,605,504 A 2/1997 Huang ..... 463/22
5,613,680 A 3/1997 Groves et al. ..... 273/138.2
5,769,458 A 6/1998 Carides et al. ..... 283/102
5,770,533 A 6/1998 Franchi ..... 463/42
5,780,831 A 7/1998 Seo et al. ..... 235/462
5,791,988 A 8/1998 Nomi ..... 463/11
5,800,268 A 9/1998 Molnick ..... 463/40
5,813,912 A 9/1998 Shultz ..... 463/25
5,830,067 A 11/1998 Graves et al. ..... 463/40
5,851,149 A 12/1998 Xidos et al. ..... 463/42
5,867,586 A 2/1999 Liang ..... 382/112
5,902,983 A 5/1999 Crevelt et al. ..... 235/380
5,903,874 A 5/1999 Leonard et al. ..... 705/14
5,919,091 A 7/1999 Bell et al. ..... 463/25
5,941,769 A 8/1999 Order ..... 463/12
5,941,771 A 8/1999 Haste, III ..... 463/17
5,999,808 A 12/1999 LaDue ..... 455/412
6,042,150 A 3/2000 Daley ..... 283/86
6,048,269 A 4/2000 Burns et al. ..... 463/25
6,062,481 A 5/2000 Storch et al. ..... 235/494
6,066,439 A 5/2000 Nohr et al. ..... 430/347
6,083,105 A 7/2000 Ronin et al. ..... 463/17
6,120,588 A 9/2000 Jacobson ..... 106/31.16
6,145,838 A 11/2000 White ..... 273/295
6,190,256 B1 2/2001 Walker et al. ..... 463/25
6,227,972 B1 5/2001 Walker et al. ..... 463/25
6,234,898 B1 5/2001 Belamant et al. ..... 463/25
6,244,958 B1 6/2001 Acres ..... 463/26
6,347,738 B1 2/2002 Crevelt et al. ..... 235/380
6,371,482 B1 4/2002 Hall, Jr. ..... 273/138.1
6,394,907 B1 5/2002 Rowe ..... 463/42
6,409,602 B1 6/2002 Wiltshire et al. ..... 463/42
6,464,584 B2 10/2002 Oliver ..... 463/25
6,468,155 B1 10/2002 Zucker et al. ..... 463/23
6,478,676 B1 11/2002 Dayan ..... 463/17
6,505,772 B1 1/2003 Mollett et al. ..... 235/379
6,508,709 B1 1/2003 Karmarkar ..... 463/42
6,527,638 B1 3/2003 Walker et al. ..... 463/25
6,547,131 B1 4/2003 Foodman et al. ..... 235/380
6,575,834 B1 6/2003 Lindo ..... 463/40
6,579,179 B2 6/2003 Poole et al. ..... 463/25
6,585,598 B2 7/2003 Nguyen et al. ..... 463/41
6,607,441 B1 8/2003 Acres ..... 463/25
6,612,928 B1 9/2003 Bradford et al. ..... 463/29
6,629,591 B1 10/2003 Griswold et al. ..... 194/205
6,638,161 B2 10/2003 Soltys et al. ..... 463/12
6,652,379 B2 11/2003 Soltys et al. ..... 463/22
6,676,522 B2 1/2004 Rowe et al. ..... 463/42
6,682,421 B1 1/2004 Rowe et al. ..... 463/25
6,688,975 B2 2/2004 Baerlocher et al. ..... 463/16
6,702,291 B2 3/2004 Grebler et al. ..... 273/292
6,739,975 B2 5/2004 Nguyen et al. ..... 463/39
6,746,330 B2 6/2004 Cannon ..... 463/25
6,752,312 B1 6/2004 Chamberlain et al. ..... 235/375
6,755,741 B1 6/2004 Rafaeli ..... 463/25
6,800,029 B2 10/2004 Rowe et al. ..... 463/25
6,811,486 B1 11/2004 Luciano, Jr. ..... 463/24
6,837,789 B2 1/2005 Garahi et al. ..... 463/29
6,866,586 B2 3/2005 Oberberger et al. ..... 463/42
6,896,618 B2 5/2005 Benoy et al. ..... 463/25
6,905,411 B2 6/2005 Nguyen et al. ..... 463/25
6,908,387 B2 * 6/2005 Hedrick et al. ..... 463/31
6,971,956 B2 12/2005 Rowe et al. ..... 463/25
6,991,540 B2 1/2006 Marlow ..... 463/16
7,011,309 B2 3/2006 Soltys et al. ..... 273/149 R
7,035,626 B1 4/2006 Luciano, Jr. ..... 455/414.1
7,063,617 B2 6/2006 Brosnan et al. ..... 463/25
7,077,332 B2 7/2006 Verschuur et al. ..... 235/492
7,086,947 B2 8/2006 Walker et al. ..... 463/25
7,099,035 B2 8/2006 Brooks et al. ..... 358/1.15
7,112,138 B2 * 9/2006 Hedrick et al. ..... 463/29
7,309,065 B2 12/2007 Yoseloff et al. ..... 273/292
7,331,520 B2 2/2008 Silva et al. ..... 235/381
7,390,256 B2 6/2008 Soltys et al. ..... 463/12
7,419,428 B2 9/2008 Rowe ..... 463/25
7,434,805 B2 10/2008 Grauzer et al. ..... 273/149 R
7,448,626 B2 11/2008 Fleckenstein ..... 273/149 R
7,500,915 B2 3/2009 Wolf et al. ..... 463/27
7,510,186 B2 3/2009 Fleckenstein ..... 273/149 R
7,510,194 B2 3/2009 Soltys et al. ..... 273/293
7,510,474 B2 3/2009 Carter, Sr. ..... 463/29
7,534,169 B2 5/2009 Amaitis et al. ..... 463/39
7,575,234 B2 8/2009 Soltys ..... 273/149 R
7,637,810 B2 12/2009 Amaitis et al. ..... 463/25
7,644,861 B2 1/2010 Alderucci et al. ..... 235/382
7,648,414 B2 1/2010 McNutt et al. ..... 463/25
7,690,995 B2 4/2010 Frankulin et al. ..... 463/41
7,753,789 B2 7/2010 Walker et al. ..... 463/42
7,780,526 B2 8/2010 Nguyen et al. ..... 463/29
2002/0111213 A1 8/2002 McEntee et al. ..... 463/42
2002/0113371 A1 8/2002 Snow ..... 273/292
2002/0142825 A1 10/2002 Lark et al. ..... 463/16
2002/0187830 A1 * 12/2002 Stockdale et al. ..... 463/29
2003/0004871 A1 1/2003 Rowe ..... 705/39
2003/0006554 A1 1/2003 Grebler et al. ..... 273/290
2003/0028480 A1 2/2003 Rowe ..... 705/39
2003/0032474 A1 2/2003 Kaminkow ..... 463/25
2003/0042679 A1 3/2003 Snow ..... 273/292
2003/0054881 A1 * 3/2003 Hedrick et al. ..... 463/29
2003/0090064 A1 5/2003 Hoyt et al. ..... 273/292
2003/0104865 A1 6/2003 Itkis et al. ..... 463/39
2003/0186739 A1 10/2003 Paulsen et al. ..... 463/25
2003/0232651 A1 12/2003 Huard ..... 463/42
2004/0002379 A1 1/2004 Parrott et al. ..... 463/29
2004/0005920 A1 1/2004 Soltys et al. ..... 463/25
2004/0029635 A1 2/2004 Giobbi ..... 463/30
2004/0033095 A1 2/2004 Saffari et al. ..... 400/120.01
2004/0127291 A1 7/2004 George et al. ..... 463/42
2004/0132529 A1 7/2004 Mkrtchyan et al. ..... 463/29
2004/0142744 A1 7/2004 Atkinson et al. ..... 463/29
2004/0150702 A1 8/2004 Tsuyoshi et al. ..... 347/100
2004/0166918 A1 8/2004 Walker et al. ..... 463/16
2004/0259618 A1 12/2004 Soltys et al. ..... 463/11
2005/0043094 A1 2/2005 Nguyen et al. ..... 463/42
2005/0054438 A1 3/2005 Rothschild et al. ..... 463/29
2005/0059479 A1 3/2005 Soltys et al. ..... 463/25
2005/0060055 A1 3/2005 Hallowell et al. ..... 700/95
2005/0070358 A1 3/2005 Angell et al. ..... 463/39
2005/0116417 A1 6/2005 Soltys et al. ..... 273/292
2005/0124411 A1 6/2005 Schneider et al. ..... 463/29
2005/0156318 A1 7/2005 Douglas ..... 257/761
2005/0176507 A1 8/2005 Ephrati ..... 463/39
2005/0181856 A1 8/2005 Cannon et al. ..... 463/16
2005/0181864 A1 8/2005 Britt et al. ..... 463/25
2005/0195432 A1 * 9/2005 Brooks et al. ..... 358/1.15
2005/0221882 A1 10/2005 Nguyen et al. ..... 463/16
2005/0227760 A1 10/2005 Vlazny et al. ..... 463/28
2005/0266919 A1 12/2005 Rowe et al. ..... 463/25
2005/0282614 A1 * 12/2005 Gauselmann ..... 463/20
2005/0282626 A1 * 12/2005 Manfredi et al. ..... 463/25
2006/0009282 A1 1/2006 George et al. ..... 463/29
2006/0019745 A1 1/2006 Benbrahim ..... 463/29
2006/0035707 A1 2/2006 Nguyen et al. ..... 463/29
2006/0046849 A1 3/2006 Kovacs ..... 463/39
2006/0121970 A1 6/2006 Khal ..... 463/16
2006/0183541 A1 8/2006 Okada et al. ..... 463/29
2006/0205508 A1 9/2006 Green ..... 463/40
2006/0205519 A1 9/2006 Soltys ..... 463/47
2006/0211481 A1 9/2006 Soltys et al. ..... 463/16
2007/0004500 A1 1/2007 Soltys et al. ..... 463/22
2007/0015583 A1 1/2007 Tran ..... 463/40

| | | | | |
|---|---|---|---|---|
| 2007/0054725 | A1 | 3/2007 | Morrow et al. | 463/16 |
| 2007/0057453 | A1 | 3/2007 | Soltys et al. | 273/149 P |
| 2007/0057454 | A1 | 3/2007 | Fleckenstein | 273/149 R |
| 2007/0057462 | A1 | 3/2007 | Fleckenstein | 273/274 |
| 2007/0057466 | A1 | 3/2007 | Soltys et al. | 273/292 |
| 2007/0060259 | A1 | 3/2007 | Pececnik | 463/16 |
| 2007/0060260 | A1 | 3/2007 | Fleckenstein | 463/16 |
| 2007/0077990 | A1 | 4/2007 | Cuddy et al. | 463/25 |
| 2007/0111775 | A1 | 5/2007 | Yoseloff | 463/16 |
| 2007/0117608 | A1 | 5/2007 | Roper et al. | 463/16 |
| 2007/0129145 | A1* | 6/2007 | Blackburn et al. | 463/42 |
| 2007/0167235 | A1 | 7/2007 | Naicker | 463/42 |
| 2007/0168251 | A1 | 7/2007 | Hilbert et al. | 705/14 |
| 2007/0198418 | A1 | 8/2007 | MacDonald | 705/52 |
| 2007/0208816 | A1 | 9/2007 | Baldwin et al. | 709/206 |
| 2007/0235521 | A1 | 10/2007 | Mateen et al. | 235/379 |
| 2007/0241497 | A1 | 10/2007 | Soltys et al. | 273/149 R |
| 2007/0241498 | A1 | 10/2007 | Soltys | 273/149 R |
| 2007/0243925 | A1 | 10/2007 | LeMay et al. | 463/20 |
| 2007/0243927 | A1 | 10/2007 | Soltys | 463/25 |
| 2007/0243935 | A1 | 10/2007 | Huizinga | 463/42 |
| 2007/0259709 | A1 | 11/2007 | Kelly et al. | 463/20 |
| 2007/0287534 | A1 | 12/2007 | Fleckenstein | 463/29 |
| 2007/0287535 | A1 | 12/2007 | Soltys | 463/29 |
| 2007/0298865 | A1 | 12/2007 | Soltys | 463/22 |
| 2007/0298868 | A1 | 12/2007 | Soltys | 463/25 |
| 2008/0004108 | A1 | 1/2008 | Klinkhammer | 463/29 |
| 2008/0038035 | A1* | 2/2008 | Shuldman et al. | 400/76 |
| 2008/0045344 | A1 | 2/2008 | Schlottmann et al. | 463/25 |
| 2008/0076572 | A1 | 3/2008 | Nguyen et al. | 463/42 |
| 2008/0090651 | A1 | 4/2008 | Baerlocher | 463/27 |
| 2008/0096659 | A1 | 4/2008 | Kreloff et al. | 463/39 |
| 2008/0113764 | A1 | 5/2008 | Soltys | 463/22 |
| 2008/0113773 | A1* | 5/2008 | Johnson et al. | 463/25 |
| 2008/0119284 | A1* | 5/2008 | Luciano et al. | 463/42 |
| 2008/0146337 | A1 | 6/2008 | Halonen et al. | 463/42 |
| 2008/0243697 | A1* | 10/2008 | Irving et al. | 705/54 |
| 2008/0311971 | A1 | 12/2008 | Dean | 463/20 |
| 2009/0005176 | A1 | 1/2009 | Morrow et al. | 463/43 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0163279 | A1 | 6/2009 | Hermansen | 463/42 |
| 2009/0191964 | A9* | 7/2009 | Baerlocher et al. | 463/31 |
| 2009/0270170 | A1 | 10/2009 | Patton | 463/36 |
| 2009/0275374 | A1 | 11/2009 | Nelson et al. | 463/16 |
| 2009/0275393 | A1 | 11/2009 | Kisenwether et al. | 463/25 |
| 2009/0275398 | A1 | 11/2009 | Nelson | 463/27 |
| 2009/0275399 | A1 | 11/2009 | Kelly et al. | 463/27 |
| 2009/0275402 | A1 | 11/2009 | Backover et al. | 463/29 |
| 2009/0275411 | A1 | 11/2009 | Kisenwether et al. | 463/42 |
| 2009/0276715 | A1 | 11/2009 | Arbogast et al. | 715/736 |
| 2009/0307069 | A1* | 12/2009 | Meyerhofer | 705/14.12 |
| 2010/0016068 | A1 | 1/2010 | White et al. | 463/25 |
| 2010/0125851 | A1 | 5/2010 | Singh et al. | 718/104 |

FOREIGN PATENT DOCUMENTS

| | | | |
|---|---|---|---|
| DE | 44 39 502 | C1 | 9/1995 |
| EP | 0 327 069 | A2 | 8/1989 |
| EP | 0 790 848 | B1 | 8/1997 |
| EP | 0 700 980 | B1 | 11/1999 |
| GB | 2 370 791 | A | 7/2002 |
| JP | 8255059 | | 10/1996 |
| KR | 2002-0061793 | | 7/2002 |
| WO | 96/14115 | | 5/1996 |
| WO | 2006/110348 | | 10/2006 |

OTHER PUBLICATIONS

Bally TMS, "MP21—Automated Table Tracking/Features," 2 pages, Nov. 2005.

Bally TMS, "MPBacc—Specifications/Specifications," 2 pages, Nov. 2005.

Burke, A., "Tracking the Tables," reprinted from *International Gaming & Wagering Business*, Aug. 2003, 4 pages.

Gros, R., "All You Ever Wanted to Know About Table Games," reprinted from *Global Gaming Business*, Aug. 1, 2003, 2 pages.

Plaintiff's Declaration of Lawrence Luciano in Opposition to Shuffle Master's Motion for Preliminary Injunction, *Card, LLC* v. *Shuffle Master, Inc.*, D. Nev. (No. CV-N-03-0244-ECR-(RAM)), Nov. 24, 2003.

Terdiman, D., "Who's Holding the Aces Now?", reprinted from *Wired News*, Aug. 18, 2003, 2 pages.

Winkler, C., "Product Spotlight: MindPlay," reprinted from *Gaming and Leisure Technology*, Fall 2003, 2 pages.

Singh et al., U.S. Appl. No. 12/271,337, filed Nov. 14, 2008, 35 pages.

International Search Report, mailed Nov. 27, 2009 for PCTAN PCT/US2009/042148, 3 pages.

Written Opinion, mailed Nov. 27, 2009 for PCTAN PCT/US2009/042148, 5 pages.

* cited by examiner

GAME TRANSACTION MODULE INTERFACE TO SINGLE PORT PRINTER

BACKGROUND

1. Technical Field

This disclosure generally relates to gaming machines.

2. Description of the Related Art

Traditionally, gaming machines have been designed for the sole purpose of presenting a game of chance, a game of skill, or a combination thereof. Accordingly, gaming devices have been constructed only to include gaming functionality. Modern gaming machines have a game module that present instances of a title and a game transaction module. The game modules are normally sanctioned by a regulatory body such as a state gaming commission and have been configured to print tickets that may include information indicative of a number of game credits. In particular, a player may purchase a number of game credits, which the player may use to access instances of a game title at a gaming machine. During a session of game play, the player may accrue game credits from playing instances of the game title and/or purchase additional game credits. When the player decides to end the session of game play, the gaming machine may "cash-out" the player by printing a ticket. At some gaming entertainment centers such as casinos, the player may redeem the ticket and/or may use the ticket to purchase additional instances of a game title.

Recently, however, casino operators have employed game transaction modules to provide additional features in gaming devices, such features may maintain a player's attention at the gaming devices for a longer period of time. For example, secondary displays have been added to gaming devices to provide players with access to gaming-related information, news, and advertisements. The gaming-related information may include, for example, information on sports betting and various betting options relating to sporting events. Additionally, the gaming-related information may include other gaming information, such as horse racing and off-track betting. News and advertisements can also maintain a player's attention by providing the player with access to information, such as, but not limited to, casino attractions, show times, restaurant and hotel specials, and world events. Additionally, these secondary displays allow casino operators to focus promotions and marketing. Accordingly, the promotions and focused marketing presented on these displays may be used to encourage further game play. In addition, casino operators may desire to present vouchers, coupons, and other promotional material, among other things, to players of gaming machines.

BRIEF SUMMARY

There exists a need for a gaming machine configured to print from multiple sources such as a game module and a game transaction module.

In addition, there exists a need for a gaming machine configured to print from multiple sources such as a game module, a game transaction module, and from other devices of a casino.

In one aspect, a method of operating a gaming system having a game module, a game transaction module, and a printer device with only one communications port may be summarized as including: receiving a first print job provided by the game module at a printer manager of the game transaction module; receiving a second print job provided by a module of the game transaction module at the printer manager of the game transaction module; arbitrating print jobs for printing content with the printer device received at the printer manager of the game transaction module; sending at least a portion of one of the first print job and the second print job from the printer device received at the printer manager of the game transaction module to the printer device via the only one communications port; and buffering at least a portion the other one of the first print job and the second print job in a memory of the game transaction module.

In another aspect, a method of retrofitting a gaming machine having a game module and a printer device with only one communications port, wherein the game module provides instances of a game title and implements a slot-accounting-system protocol includes: communicatively coupling a game transaction module configured to interface with the game module in accordance to the slot-accounting-system protocol and configured to interface with a remote computing device in accordance with a game-to-system protocol to the remote computing device; communicatively coupling the game transaction module to the only one communications port of the printer device; and providing a printer manager configured to arbitrate print jobs for the printer device.

Figure 1:
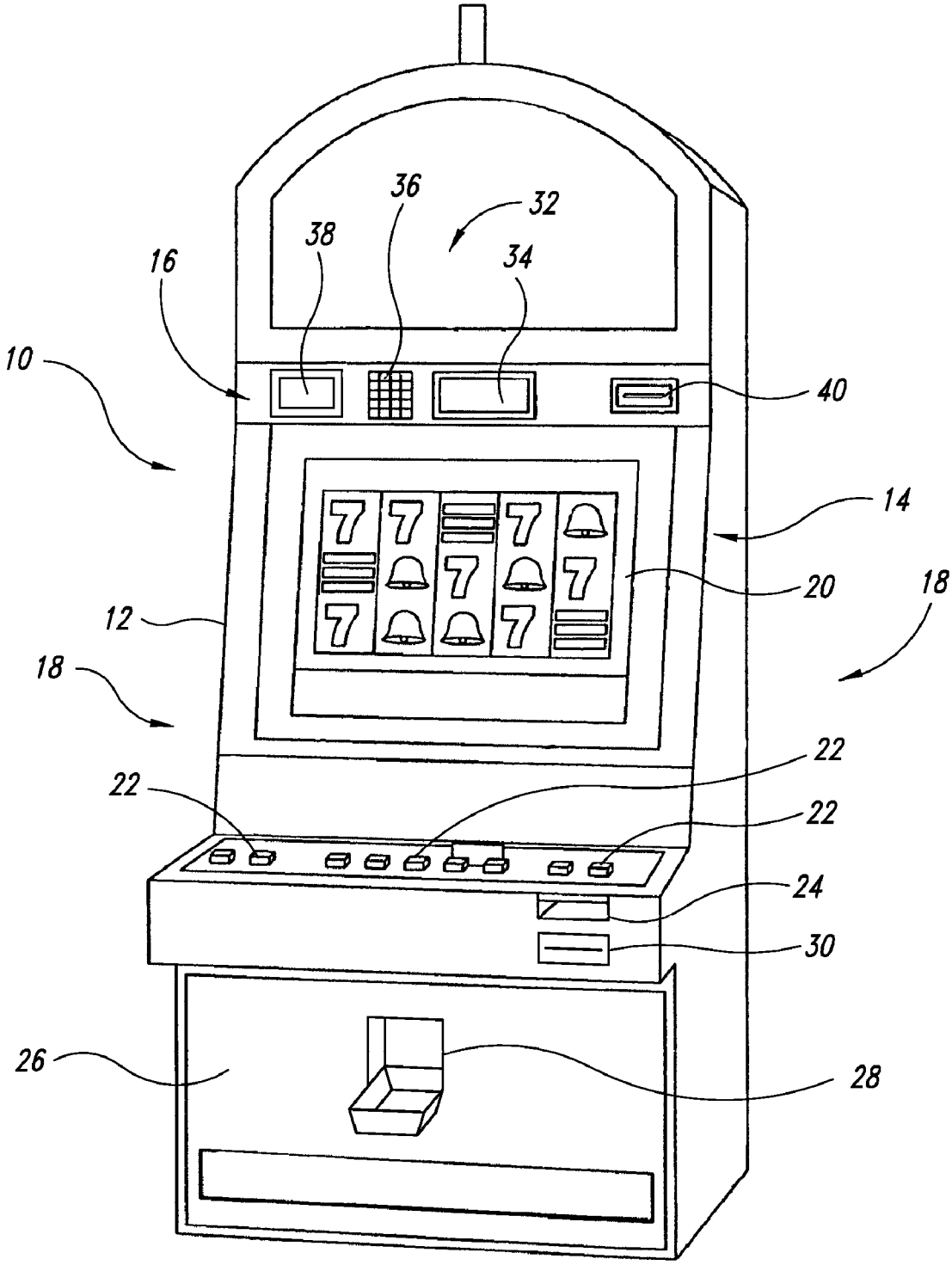
FIG. 1 is an isometric view of a gaming machine according to one non-limiting illustrated embodiment.

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with gaming devices, networks, integrated circuits, and computing devices have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Any process descriptions or blocks in flowcharts described below may be understood as representing modules, segments, or portions of code which include one or more executable instructions for implementing specific logical functions, or acts. In alternative embodiments, various logical functions, or acts may be executed out of order from that shown or discussed, including substantially concurrently or in reverse order, and/or manually, depending on the functionality involved, as would be understood by those reasonably skilled in the art.

FIG. 1 shows a gaming device 10 according to one non-limiting illustrated embodiment. The gaming device 10 includes a housing or cabinet 12. The cabinet 24 may be a self-standing unit that is generally rectangular in shape. In other embodiments, the cabinet (not shown) may be a slant-top, bar-top, or table-top style cabinet. However, any shaped housing may be used with embodiments of the gaming device 10. The cabinet 12 houses a game module 14 and a game transaction module 16.

The game module 14 includes a game module player interface 18 having a game module display 20 and player input devices such as a plurality of game module player-actuatable buttons 22. The game module display 20 may present one or more games of chance, such as, but not limited to, slots, keno, roulette, Class II bingo, lottery, craps, representations of various wheel games, etc. One example game of chance is BLAZING 7's by Bally Technologies, Inc. In other embodiments, the game module display 20 may present games of skill such as, but not limited to, blackjack and poker. In one embodiment, the game module display device 20 may be a CRT or a panel display, such as, but not limited to, liquid crystal, plasma, electroluminescent, vacuum fluorescent, field emission, or any other type of panel display. Additionally, the game module display device 20 may also include a touch screen or touch glass system.

In one embodiment, the game module player-actuatable buttons 22 may be replaced with other input devices, such as, but not limited to, a touch screen system, touch pad, track ball, mouse, switches, or toggle switches. For example, one potential input device is a universal button module as disclosed in U.S. patent application Ser. No. 11/106,212, entitled "Universal Button Module," filed on Apr. 14, 2005, which is hereby incorporated by reference in its entirety. The universal button module may provide a dynamic button system adaptable for use with various games and capable of adjusting to gaming devices having frequent game changes.

The game module 14 also includes an item-of-value validator 50 (FIG. 2) and an item-of-value validator opening 24 defined in a front face 26 of the cabinet 12. The item-of-value validator opening 24 is sized and shaped to receive purported items-of-value such as tickets and respective units of a respective currency, e.g., United States of America one-dollar bills, United States of America twenty-dollar bills, etc. Purported items-of-value are received by the item-of-value validator opening 24 and provided to the item-of-value validator 50.

In some embodiments, the game module 14 also includes an item-of-value dispenser (not shown) and an item-of-value dispenser opening 28 defined in the front face 26 of the cabinet 12. The item-of-value dispenser opening 28 is sized and shaped to dispense items-of-value such as, but not limited to, respective units of a respective currency, casino tokens or chips, and/or other items that a player may redeem at a casino having the gaming device 10. Payouts from a player having a successful/winning instance of a game played on the gaming device 10 can be provided to the player by the item-of-value dispenser via the item-of-value dispenser opening 28.

The game module 14 also includes a printer device 82 (FIG. 2) and a printer output opening 30 defined in the front face 26 of the cabinet 12. The printer output opening 30 is sized and shaped to present printed items (not shown) to a player of the gaming device 10. Printed items are received by the printer output opening 30 from the printer device 82 such that at least a portion of a respective instance of printed medium extends outward from an interior of the gaming device 10 via the printer output opening 30. Nonlimiting examples of respective instances of printed medium include tickets, coupons, vouchers, etc. In some embodiments, the printer device 82 may print a respective printed item that may be presented to a player via the dispenser opening 28.

The game transaction module 16 may be positioned above the game module display device 20, as shown in FIG. 1. Alternatively, the game transaction module 16 may be positioned below or next to the game module display device 20 or in any other location.

The game transaction module 16 includes a game transaction module player interface 32 having a game transaction module display device 34 and game transaction module input devices such as a keypad 36 and a touch pad 38. The keypad 36 may be configured with a plurality of alphanumeric buttons, numerical buttons, a combination thereof, and the like. The alphanumeric buttons may allow a player to input numbers, alphabetical characters, or symbols. The numerical buttons may allow a player to only input numbers. In one embodiment, the keypad 36 may have a three dimensional aspect that changes to reflect activation. Additionally, the keypad 36 may include one or more dedicated function buttons. The functions may include enter, clear, cancel, yes, no, forward, or back. In one embodiment, the keypad 36 is a secured keypad. That is, once any data (e.g., a personal identification number (PIN) or credit card number) is inputted, the data may be encrypted so that all PIN-related transactions comply with industry standards for credit card and automated teller machine (ATM) transactions. Accordingly, a player may use an ATM, a debit card, or a credit card, in lieu of cash to play one or more instances of a game on the gaming device 10. Alternatively, other cashless technology may similarly be used.

The touchpad 38 may comprise a generally rectangular pad may include one or more buttons (not shown). The buttons, if any, may be used in combination with the touchpad 38 to provide the player with additional means of inputting data. In an alternate embodiment, an annular touchpad (not shown) may be provided in association with the game transaction module 16. The touchpad 38 may allow a player to navigate around the game transaction module display device 34 with a pointer, scroll through menus, make selections based upon information provided on the display, or input data.

The game transaction module display device 34 may display any visual screen images (e.g., pictures, characters, symbols, icons) and video images that have been converted for compatibility with digital or computer manipulation, transport and storage.

In one embodiment, the game transaction module display device 34 for the game transaction module player interface 32 may comprise a panel display, such as, but not limited to, liquid crystal, plasma, electroluminescent, vacuum fluorescent, field emission, or any other type of panel display. In another embodiment, the game transaction module display device 34 may comprise a transparent LCD display. According to one embodiment, the game transaction module display device 34 may be a 320×240 display. In another embodiment, the graphics display 12 may be a 640×240 display. However, virtually any size, resolution or type of display may be used in conjunction with the game transaction module player interface 32.

The game transaction module player interface 32 may also include a reader 70 (FIG. 2) and a reader opening 40. The reader opening 40 may be sized and shaped to receive various items that carry or encode information. Exemplary, nonlimiting, items carrying or encoding information include printed paper, printed plastic, cards, and smart cards. In some embodiments, received items may carry one or more machine-readable symbols (e.g., bar code symbols, stack code symbols, area or matrix code symbols). In some embodiments, received items may carry a magnetic strip such as, but not limited to, financial medium units (e.g., credit cards, debit cards, ATM cards, prepaid cards) issued by financial institutions and loyalty or club membership cards that may be issued by a casino. In some embodiments, received items may carry electrical circuitry adapted to wirelessly communicate, such as Radio Frequency Identification Devices (RFID) and smart cards. In some embodiments, received items may carry information in the form of human readable indicia. In some embodiments, received items may carry information such as one or more of: an indicator indicative of a number of credits; an indicator indicative of account, which may have a number of credits associated therewith; indicator indicative of player; and an indicator of a membership club, which may be affiliated with a casino; and an indicator indicative of a club membership identifier, where the club may be affiliated with a casino and the club membership identifier is associated with a respective player. In addition, a received item may carry information identifying and/or an indicator indicative of information identifying a person as an employee of a casino, etc. Items received by reader opening 40 are provided to the reader 70.

Figure 2:
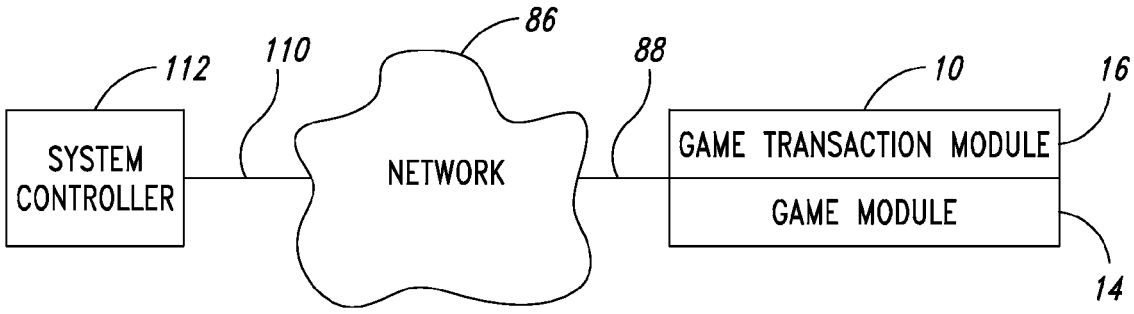
FIG. 2 is a block diagram of a gaming entertainment system including the gaming machine of FIG. 1, according to one non-limiting illustrated embodiment.

FIG. 2 shows a block diagram of a gaming entertainment system 114 such as a casino in accordance with one illustrated embodiment. The gaming entertainment system 114 includes a system controller 112 and the gaming device 10. The game transaction module 16 may also be communicatively coupled to a network 86 via a communications link 88. The communications link 88 may take a variety of forms including wireless communications links and/or wired communications links. The communication network 86 may take a variety of forms such as a Local Area Network (LAN), a Wide Area Network (WAN). The communications network 86 may communicatively couple the gaming device 10 to various components and equipment of a casino, among other things.

The system controller 112 is communicatively coupled to the network 86 via a communications link 110. The system controller 112 may communicate with the game transaction module 16 of the gaming device 10 in accordance with various protocols such as, but not limited to, game-to-system (G2S) protocol.

Among other things, the system controller 112 may include one or more accounting subsystems. The accounting subsystems may receive information from the gaming device 10 and based at least on the information, the accounting subsystems may reconcile amounts collected by the gaming device 10 and amounts paid out by the gaming device 10.

Among other things, the system controller 112 may include one or more marketing/bonusing subsystems. The marketing/bonusing subsystems may receive information from the gaming device 10. The information may be indicative of game play such as amount wagered, average amount wagered, rate of play, etc. The information may include a club membership indicator indicative of a membership account associated with a given player. Based at least on the received information, the marketing/bonusing subsystems may provide the gaming device 10 with commands and/or structured data for presentation to the player of the gaming device. For example, the gaming device 10 may present the player with an opportunity for a coupon and/or voucher based at least on the provided commands and/or structured data.

Figure 3:
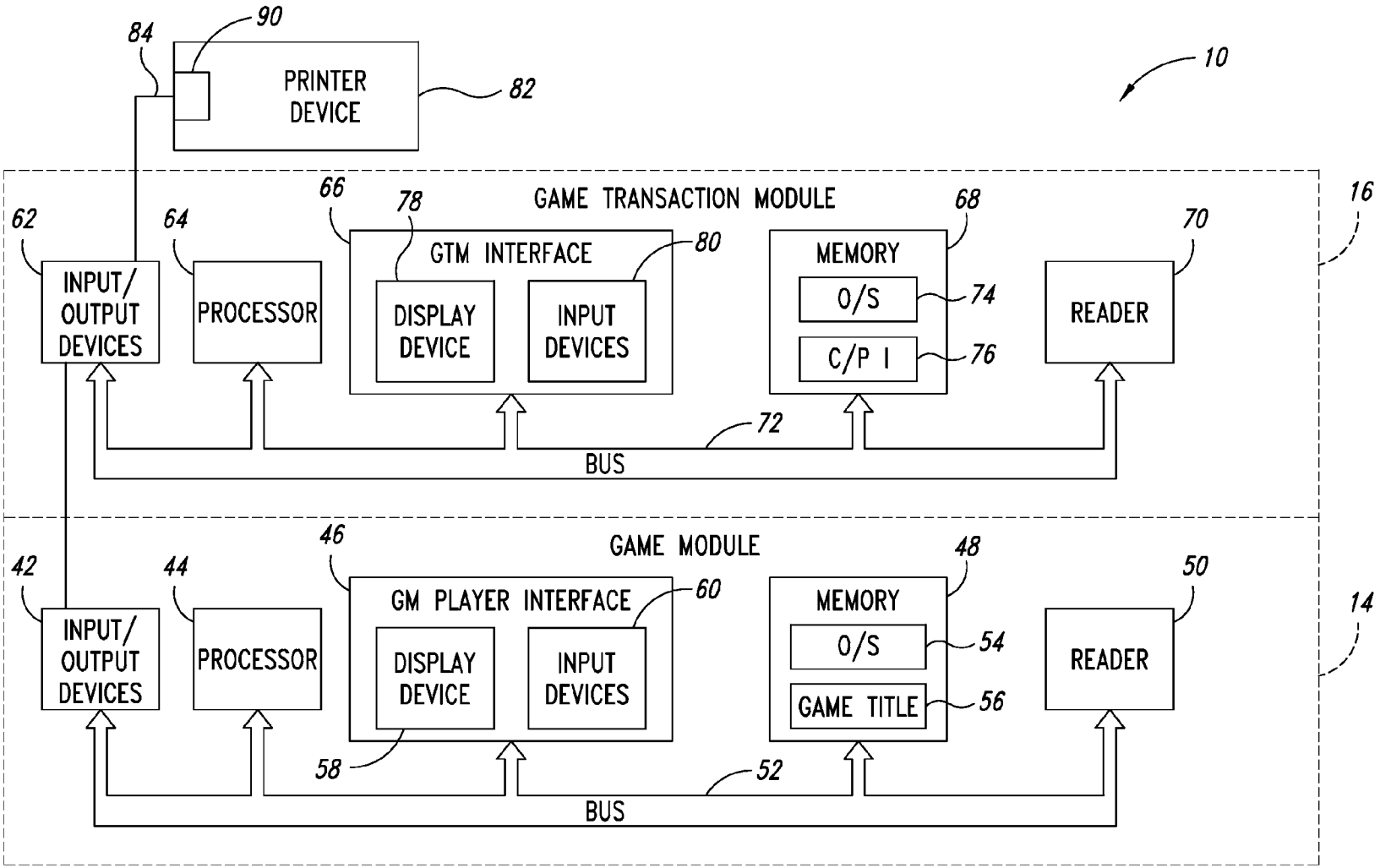
FIG. 3 is a schematic of the gaming machine of FIG. 1, according to one non-limiting illustrated embodiment.

FIG. 3 shows a schematic of the gaming device 10 in accordance with one nonlimiting example. The gaming device 10 includes the game module 14, the game transaction module 16 and a printer device 82. The game transaction module is coupled to the printer device 82 by a communication link 84. The game module 14 includes input/output devices 42, a processor 44, a game module player interface 46, a memory 48, and an item-of-value validator 50, which are communicatively coupled by one or more buses 52.

The processor 44 may be a device for executing software, particularly that stored in the memory 48. The processor 44 may be a custom made or commercially available processor, a central processing unit (CPU), a semiconductor based microprocessor (in the form of a microchip or chip set), or generally any device for executing software instructions.

The memory 48 may include any one or combination of volatile memory elements such as a read-only memory (ROM) and a random access memory (RAM). The random access memory (RAM) may include dynamic random-access memory (DRAM), static random-access memory (SRAM), synchronous dynamic random-access memory (SDRAM), flash RAM, etc.

The memory 48 may store one or more logic modules or logic routines, each of which may comprise an ordered listing of executable instructions for implementing logical functions. In particular, the memory 48 includes an operating system 54 and game title logic 56. The execution of the operating system 54 by the processor 44 essentially controls the execution of other logic, such as game title logic 56 and provides scheduling, input-output control, file and data management, memory management, and communication control and related services.

The game title logic 56 may include various logic modules or logic routines, each of which may comprise an ordered listing of executable instructions for implementing logical functions. In particular, the game title logic 56 may include logic to provide instances of a game such as a slot based game, blackjack, roulette, etc. The game title logic 56 may further include random number generators, logic that controls collection of wagers, and logic that control payouts.

The validator 50 may be configured to validate purported items of value. The validator 50 may determine whether a purported item of value is a valid ticket, a valid unit of a currency, or a valid financial medium, etc. For example, the validator 50 may determine whether a purported item of value is a valid unit of a currency, such as, but not limited to, a United States (U.S.) dollar bill, a U.S. five-dollar bill, a U.S. ten-dollar bill, a U.S. twenty-dollar bill, etc. In some embodiments, the validator 50 may be configured to validate units of currency for multiple currencies. The units of currency may be used to purchase game credits for playing the gaming device 10.

The validator 50 may be also configured to validate received tickets and/or vouchers. Among other things, the validator 50 may read (e.g., a unique identifier) an identifier from a ticket/voucher, and the identifier may be used to determine a respective number of game credits associated with tickets/vouchers. Alternatively, the validator 50 may read information indicative of a respective number of game credits from tickets/vouchers.

The game module player interface 46 includes a display device 58 and input devices 60 and may further include other optional devices such as, but not limited to, speakers (not shown). Input devices 60 may take a variety of forms including various keys, track wheel, track ball, joy stick, key pad, number pad, touch pad, touch screen, user selectable icons, etc. The display device 58 may take a variety of forms, for example cathode ray tube (CRT) displays, or flat panel displays such as liquid crystal (LCD) displays, liquid crystal on silicon (LCoS) displays, plasma displays, digital light processing (DLP) displays, other projection type of displays, and touch sensitive displays. A player may use the game module player interface 46 to select a game, control and play a game, place a wager, among other things.

Input/output devices 42 may include various network cards/ports that provide communications with the game transaction module 16. As nonlimiting examples, input/output devices 42 may include Universal Serial Bus (USB) cards/ports, IEEE 1394 (FireWire) cards/ports, Ethernet cards/ports, parallel ports, and serial ports such as RS-232 standard.

The game transaction module 16 may include input/output devices 62, processor 64, game transaction module player interface 66, memory 68, and reader 70, which are communicatively coupled by one or more buses 72.

The processor 64 may be a device for executing software, particularly that stored in the memory 68. The processor 64 may be a custom made or commercially available processor, a central processing unit (CPU), a semiconductor based microprocessor (in the form of a microchip or chip set), or generally any device for executing software instructions.

The memory 68 may store one or more logic modules or logic routines, each of which may comprise an ordered listing of executable instructions for implementing logical functions. In particular, the memory 68 includes an operating system 74 and Casino/Player Interface logic 76. The execution of the operating system 74 by the processor 64 essentially controls the execution of other logic, such as Casino/Player Interface logic 76 and provides scheduling, input-output control, file and data management, memory management, and communication control and related services.

The reader 70 may take a variety of forms including, but not limited to, one or more magnetic stripe readers. Alternatively, or additionally, the reader 70 may take the form of one or more optical machine-readable symbol readers operable to read information encoded into one or more machine-readable symbols (e.g., barcode symbols, stacked code symbols, area or matrix code symbols, etc.). In addition, the reader 70 may take the form of one or more RFID readers or interrogators operable to acquire information encoded into one or more RFID carriers (e.g., tags or cards).

The reader 70 may be used to read, among other things, received items such as player club cards issued by the casino (e.g., player promotional cards, player tracking cards, loyalty program cards), casino employee cards, smart cards, and the like. Additionally, the reader 70 may be configured to accept and/or read information from units of financial medium (e.g., credit cards, debit cards, ATM cards, prepaid cards) issued by financial institutions. Generally, the reader 70 may monitor and track player and employee activity each time a player or employee inserts his or her card into the reader 70.

The game transaction module player interface 66 includes a display device 78 and input devices 80 and may further include other optional devices such as, but not limited to, speakers (not shown). Input devices 80 may take a variety of forms including various keys, track wheel, track ball, joy stick, key pad, number pad, touch pad, touch screen, user selectable icons, etc. The display device 78 may take a variety of forms, for example cathode ray tube (CRT) displays, or flat panel displays such as liquid crystal (LCD) displays, liquid crystal on silicon (LCoS) displays, plasma displays, digital light processing (DLP) displays, other projection type of displays, and touch sensitive displays.

Input/output devices 62 may include various network cards/ports that provide communications with the game transaction module 16 and the printer device 82. As nonlimiting examples, input/output devices 62 may include Universal Serial Bus (USB) cards/ports, IEEE 1394 (FireWire) cards/ports, Ethernet cards/ports, parallel ports, and serial ports such as RS-232 standard.

The printer device 82 includes a communications port 90. Communications from the game transaction module 16 are received at the communications port 90 via the communications link 84. The printer 82 and the game transaction module 16 may communicate in accordance with a printer protocol. The communications port 90 of the printer device 82 also receives print data from the game transaction module 16 via the communications link 84.

Figure 4:
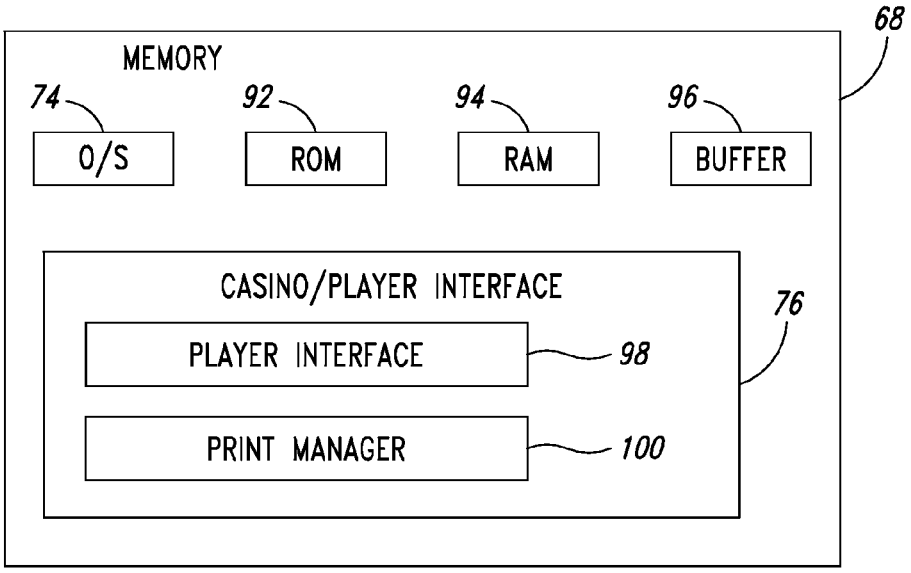
FIG. 4 is a block diagram of a memory of the gaming machine of FIG. 3, according to one non-limiting illustrated embodiment.

FIG. 4 shows a block diagram of the memory 68 of the game transaction module 16 according to one non-limiting embodiment. The memory 68 may include any one or combination of volatile memory elements such as a read-only memory (ROM) 92 and a random access memory (RAM) 94 including buffer 96. The random access memory (RAM) 94 may include dynamic random-access memory (DRAM), static random-access memory (SRAM), synchronous dynamic random-access memory (SDRAM), flash RAM, etc. The buffer 96 may be a data buffer that stores, temporally, print data.

The Casino/Player Interface logic 76 may include various logic modules or logic routines, each of which may comprise an ordered listing of executable instructions for implementing logical functions. In particular, the Casino/Player Interface logic 76 may include logic to interface with the game module 14 and with other components and/or equipment of a casino. In some embodiments, the Casino/Player Interface logic 76 may interface with gaming systems comprised other components and/or equipment of a casino via the communications network 86 in accordance with a protocol such as Game-To-System (G2S), which enables secure communications between gaming device 10 and gaming systems. In some embodiments, the Casino/Player Interface logic 76 may interface with the game module 16 in accordance with a protocol such as Slot Accounting System (SAS) protocol. In some embodiments, the Casino/Player Interface logic 76 include player interface logic 98 and print manager logic 100.

Among other things, the Casino/Player Interface logic 76 may include logic to enhance a player's gaming experience at the gaming device 10. The Casino/Player Interface logic 76 may include device customization logic that customizes the gaming device 10 in accordance with a player's preferences. For example, a player may have a club membership card issued by a casino. The player's club membership card may carry player information which may be read from the club membership card by the reader 70. The player information may include a player's name, identification number, gaming habits, player rating, or the like. Other player information stored on or associated with a club membership card may be related to a player's non-gaming preferences and/or interests, such as, but not limited to, shows, favorite restaurants, favorite foods or drinks, or any combination thereof. Additionally, player information stored on or associated with a club membership card may be related to a player's gaming preferences, such as, but not limited to, favorite types of games, speed of game (e.g., fast or slow game play), font size on the game display 26, preferred wager denominations, preferred number of paylines to be played, or a combination thereof. By providing this information on the club membership card, the gaming device 10 may be customized to the player's preferences once the club membership card has been inserted into the card reader 18, thereby enhancing the player's gaming experience.

In some embodiments, the Casino/Player Interface logic 76 may customize the gaming device 10 based at least on information that may be received or accessed in a number of ways. For example, the aforementioned information may be stored in a storage device coupled to the network 86. The gaming device 10 may access the stored information based at least on an identifier indicator read from a player's club membership card. Alternatively, gaming device 10 may access the stored information based at least on information provided by the player via the game transaction module player interface 66. As another example, the player may provide information, via the game transaction module player interface 66, that may be used to customize the gaming device 10.

The Casino/Player Interface logic 76 may present the player with information via the game transaction module display device 78. For example, player information such as the player name and/or player rating may be displayed on the game transaction module display device 78. The game transaction module display device 78 may also display advertisements, player services information, gaming-related information, system gaming, and game parameters for the game displayed on the gaming device 10. For example, player services information may pertain to casino promotions, show times, restaurant choices, or hotel specials. The gaming-related information may include, for example, information on sports betting and various betting options for those sporting events. For example, the gaming-related information may include information relating to horse racing and/or off-track betting. Alternatively, the information presented on the game transaction module display device 78 may be non-gaming-related information, such as, but not limited to, local or world news. System gaming relates to games that may be presented on the game transaction module display device 78. Game parameters presented on the game transaction module display device 78 may include speed of game (e.g., fast or slow game play), font size on the game module display device 58, wager denomination, number of paylines to be played, or any combination thereof.

In one embodiment, this information may be presented on the game transaction module display device 78 whether or not a player is identified by a club membership card or by information input by a player. For example, a casino operator may determine a default list of services that may be provided to or accessed by the Casino/Player Interface logic 76 via the network 86. In another embodiment, the Casino/Player Interface logic 76 may present the player with a series of menus or questions via the game transaction module player interface 66, and the presented information may be based at least on player menu selections and/or answers to particular questions.

The Casino/Player Interface logic 76 may cause print data to be provided to the printer device 82 based at least on player input received via the game transaction module player interface 66. For example, the Casino/Player Interface logic 76 may present the player with an opportunity to receive a discount coupon. If the player selects to receive the discount coupon and provides appropriate player input via the game transaction module player interface 66, then the Casino/Player Interface logic 76 will cause the printer device 82 to be provided with the appropriate print data such that the printer device 82 may print the discount coupon.

Among other things, the printer manager logic 100 receives print commands and print data from various sources such as, but not limited to, the game module 14, computing devices and/or servers such as system controller 112 coupled to the network 86, and from the player interface 98. The printer manager logic 100 also interfaces with the printer device 82 and arbitrates printer conflicts.

In some embodiments, all print commands for the printer device 82 are processed by the printer manager logic 100. The printer manager logic 100 may receive print commands and process the print commands based on various criteria such as, but not limited to, printer device 82 availability, size of print job, source of print job, first-in first-out, etc. The printer manager logic 100 arbitrates print commands from the various sources such that the printer device 82 will have a sufficient amount of available memory for receiving a respective print command.

The player interaction logic 98 may include various logic modules or logic routines, each of which may comprise an ordered listing of executable instructions for implementing logical functions. In particular, the player interaction logic 98 may include logic to interface with the game transaction module display device 78 and the game transaction module input devices 80. Among other things, the player interaction logic 98 may receive information via the network 86 and present at least a portion of the received information on the display device 78. For example, a casino operator or a device such as the system controller 112 may determine to present the player with a discount coupon, and the player interaction logic 98 may present the player with an opportunity to accept the coupon via, for example, the display device 78. The player may choose to accept the coupon by providing input via the input devices 80. The player interaction logic 98 may provide the printer manager 100 with print data. The print data may correspond to data necessary for printing an entire coupon.

Alternatively, the print data provided by the player interaction logic 98 may correspond to a portion of data necessary for print an entire coupon and/or other templates such as ticket templates. For example, in some embodiments, the printer device 82 may have data corresponding to a coupon template. When the printer device 82 may print a coupon based at least on the data corresponding to the coupon template and print data provided by the player interaction logic 98.

In some embodiments, the printer manager 100 may have data corresponding to a coupon template and/or other templates such as ticket templates. The printer manager 100 may provide the printer device 82 with print data corresponding to the coupon template and the print data provided by the player interaction logic 98.

In some embodiments, the Casino/Player Interface logic 76 may receive print data via the network 86 and cause at least a portion of the print data to be provided to the printer device 82. In some embodiments, print data may be stored in the memory 68 and the Casino/Player Interface logic 76 may receive print commands via the network 86, the Casino/Player Interface logic 76 may cause the stored print data to be provided to the printer device 82 based at least on the received print commands. In some embodiments, print data may be stored in at the printer device 82, and the Casino/Player Interface logic 76 may cause print commands to be provided to the printer device 82. The provided print commands may be provided in response to a command or commands received via the network 86.

A player may also initiate a printing of an item via the game module player interface 46. For example, the player may quit playing the gaming device 10 by providing player input via the game module player interface 46. Based at least on the player input, the processor 44 executing the game title logic 56 may cause the printer device to print an item such as a ticket. When a player quits playing the gaming device 10, the game module 14 may provide the game transaction module 16 with information such as a number of credits and game device information. Game device information may be indicative of a game device identifier that identifies the gaming device 10. Game device information may also be indicative of an authenticator that may authenticate a printed item.

Figure 5:
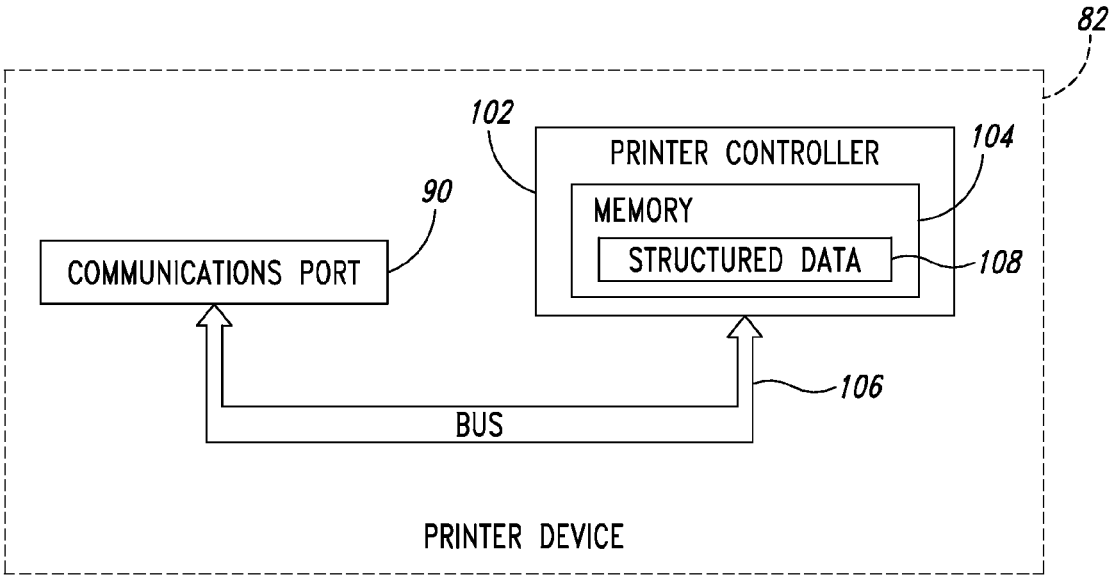
FIG. 5 is a schematic diagram of a printer device of the gaming machine of FIG. 3, according to one non-limiting illustrated embodiment.

FIG. 5 shows a schematic of the printer device 82 in accordance with one nonlimiting example. The printer device 82 includes the communications port 90, a printer controller 102 having a memory 104, and one or more buses 106.

The printer controller 102 may be a device for executing software, particularly that stored in the memory 104. The printer controller 102 may be a custom made or commercially available processor, a central processing unit (CPU), a semiconductor based microprocessor (in the form of a microchip or chip set), or generally any device for executing software instructions.

In some embodiments, the printer controller 102 or a portion of the printer controller 102 may be implemented in firmware that is stored in the memory 104 and that is executed by a suitable instruction execution system. If implemented in hardware, as in an alternative embodiment, the printer controller 102 and/or various logic modules or logic routines of the printer controller 102 can be implemented with any or a combination of the following technologies: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

The memory 104 may include any one or combination of volatile memory elements such as a read-only memory (ROM) 108 and a random access memory (RAM) 110. The random access memory (RAM) 110 may include dynamic random-access memory (DRAM), static random-access memory (SRAM), synchronous dynamic random-access memory (SDRAM), flash RAM, etc. The RAM 110 may buffer print data received from the printer manager 100 via the communications port 90. The memory 104 may have various sets of structured data stored therein such as one or more coupon templates, one or more ticket templates, etc.

The printer controller 102 may communicate with the printer manager 100 in accordance with a printer protocol. The printer controller 102 may respond to queries from the printer manager 100 such as printer availability and/or amount of available memory for receiving print data, etc. The printer controller 102 may periodically or intermittently report to the printer manager 100 information such as printer availability and/or amount of available memory for receiving print data, etc.

The printer controller 102 may process print jobs for printing items such as coupons and tickets based at least on communications received from the printer manager 100. The communications may include commands and/or data received from the printer manager 100.

In some embodiments, the communications port 90 is the only communications port of the printer device 82. The communications port 90 may be a Universal Serial Bus (USB) port, IEEE 1394 (FireWire) port, Ethernet port, or serial ports such as RS-232 standard.

Figure 6:
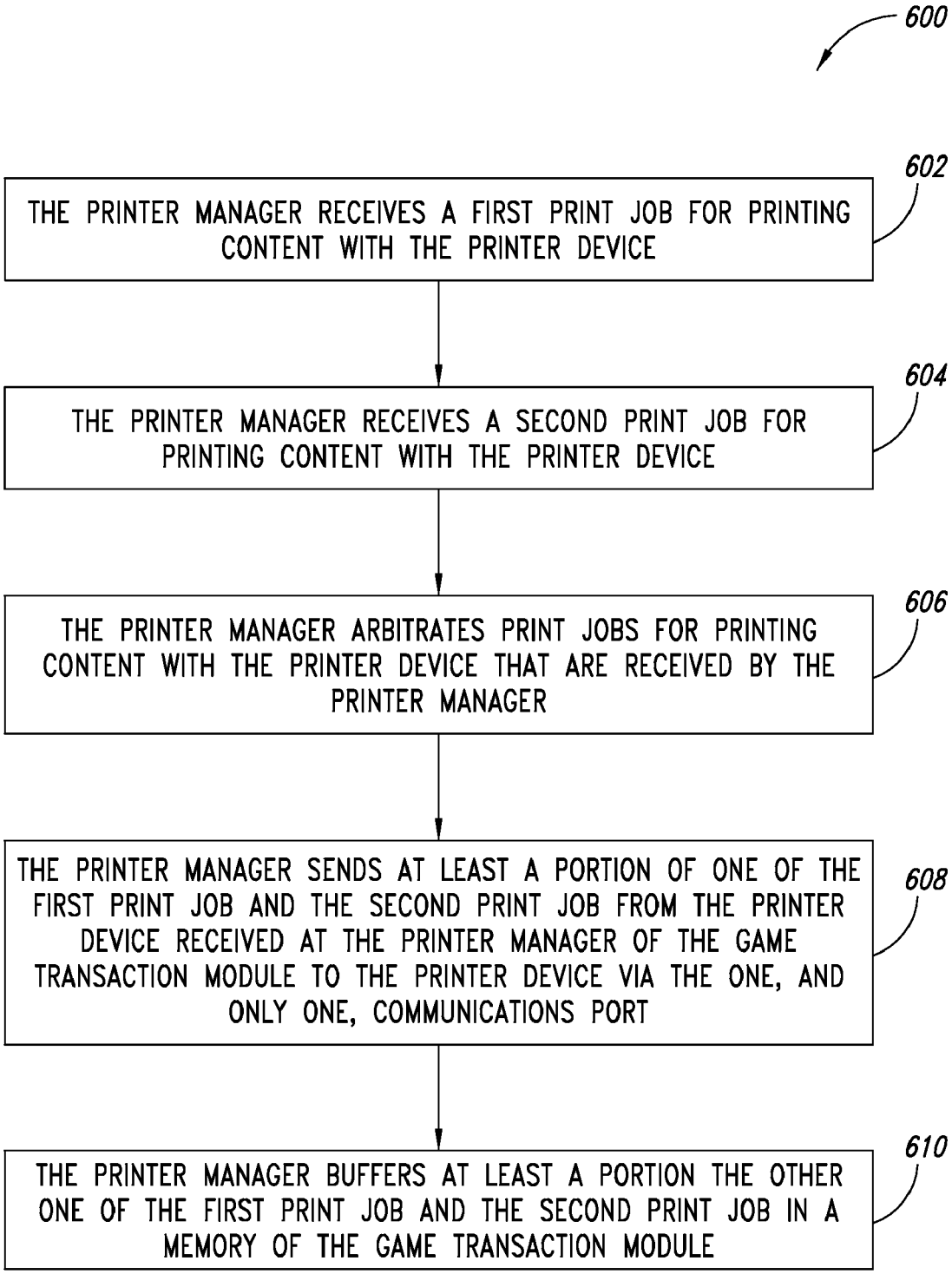
FIG. 6 is a flow chart of an exemplary process to operate a gaming device according to one non-limiting illustrated embodiment.

FIG. 6 shows a flow chart of an exemplary process 600 to operate a gaming device having a game module, a game transaction module, and a printer device with only one communications port, according to one non-limiting illustrated embodiment. Certain acts in the processes or process flow described in all of the logic flow diagrams referred to below must naturally precede others to function as described. However, the various embodiments are not limited to the order of the acts described if such order or sequence does not alter the functionality of one or more of the embodiments. That is, it is recognized that some acts may be performed before, after, or in parallel with other acts. Further, some embodiments, may include additional acts and/or omit other acts.

At 602, the printer manager receives a first print job. The first print job may be from the system controller 112, the game module 14, or the player interface 98. The first print job may include various commands and may include print data. The first print job is for printing content with the printer device 82.

At 604, the printer manager receives a second print job. The second print job may be from the system controller 112, the game module 14, or the player interface 98. The second print job may include various commands and may include print data. The second print job is for printing content with the printer device 82.

At 606, the printer manager arbitrates print jobs for printing content with the printer device that are received by the printer manager. For example, the printer manager may arbitrate conflicts between print jobs from the game module and from the system controller. When simultaneous print jobs are received, the printer manager handles the collision and pooling of the print jobs and makes certain that both print jobs are printed. Similarly, when a first print job is received and is followed by a second print job, the printer manager may handle any collision between the two print jobs and pooling of the print jobs and may make certain that both print jobs are printed in temporal order in which they were received.

At 608, the printer manager sends at least a portion of one of the first print job and the second print job from the printer device received at the printer manager of the game transaction module to the printer device via the only one communications port.

At 610, the printer manager buffers at least a portion the other one of the first print job and the second print job in a memory of the game transaction module.

In some situations, the game module 14 may be sanctioned by a regulatory body such as a state gaming commission. In that case, changes to the game module 14 may need to be approved by the regulatory body. The game transaction module on the other hand is not a module that must be sanctioned by a regulatory body, and consequently, the game transaction module 14 may be modified without obtaining prior approval by the regulatory body. Some current gaming devices 10 have a printer device with only one communications port that is communicatively coupled to the game module 14 for printing, among other things, tickets that may carry an indicator of a number of game credits.

Figure 7:
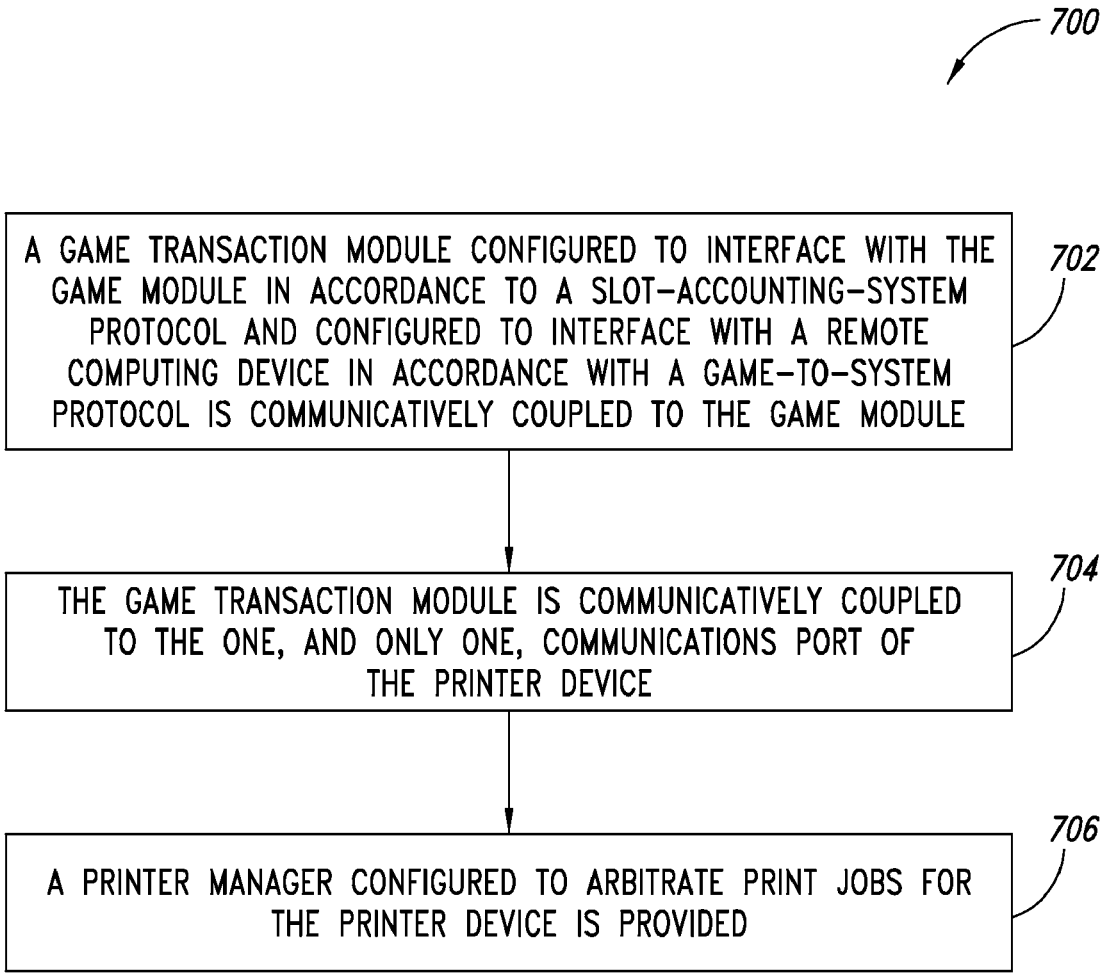
FIG. 7 is a flow chart of an exemplary process to retrofit a gaming machine according to one illustrated embodiment.

FIG. 7 shows a flow chart of an exemplary process 700 to retrofit a gaming machine having a game module and a printer device with only one communications port, according to one illustrated embodiment. The game module may be a regulated module for which modifications thereto require approval by a regulatory body. The game module may implement a slot-accounting-system protocol.

At 702, a game transaction module configured to interface with the game module in accordance to the slot-accounting-system protocol and configured to interface with a remote computing device in accordance with a game-to-system protocol to the remote computing device is communicatively coupled to the game module.

At 704, the game transaction module is communicatively coupled to the only one communications port of the printer device.

At 706, a printer manager configured to arbitrate print jobs for the printer device is provided.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that the mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

The various embodiments described above can be combined to provide further embodiments. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet disclosure are incorporated herein by reference, in their entirety. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of operating a gaming system having a game module, a game transaction module, and a printer device with only one communications port, the method comprising:

receiving game information indicative of a number of game credits from the game module at the game transaction module, wherein the game transaction module includes a processor, a memory and a system bus distinct and separate from a processor, a memory and a system bus of the game module;

receiving a first print job provided by the game module at a printer manager that is part of the game transaction module;

receiving a second print job provided by a module of the game transaction module at the printer manager that is part of the game transaction module;

arbitrating print jobs for printing content with the printer device received at the printer manager of the game transaction module;

sending at least a portion of one of the first print job and the second print job received at the printer manager of the game transaction module to the printer device via the only one communications port;

buffering at least a portion of the other one of the first print job and the second print job in a memory of the game transaction module; and providing at least a portion of the game information indicative of the number of game credits to a remote accounting system.

2. The method of claim 1 wherein the first print job includes a data structure indicative of a number of game credits.

3. The method of claim 1, further comprising:

receiving user-input indicative of termination of a respective session of game play at the game module by a respective player from a game module user interface of the game module; and providing the first print job to the printer manager of the game transaction module in response to the user-input received at the game module user interface of the game module.

4. The method of claim 3, further comprising:

receiving user-input at a game transaction module user interface of the game transaction module;

providing the second print job to the printer manager of the game transaction module in response to the user-input received at the game transaction module user interface of the game transaction module.

5. The method of claim 4, further comprising:

receiving a first set of structured data from a remote server at the game transaction module; and providing the second print job to the printer manager of the game transaction module after receiving the first set of structured data, the second print job including a second set of structured data related to the first set of structured data.

6. The method of claim 1, further comprising:

receiving a first set of structured data from a remote server at the game transaction module; and providing the second print job to the printer manager of the game transaction module after receiving the first set of structured data, the second print job including a second set of structured data related to the first set of structured data.

7. The method of claim 1, further comprising:

presenting a game to a player by the game module; and presenting information to the player by the game transaction module that is unrelated to the game which the game module is presenting to the player.

8. The method of claim 7 wherein presenting information to the player by the game transaction module that is unrelated to the game which the game module is presenting to the player includes presenting at least one of news or advertisements.

9. The method of claim 8 wherein presenting at least one of Previously Presenteds or advertisements includes presenting at least one opportunity to dispense a printed coupon redeemable for at least one of an attraction, a meal or a beverage.

10. The method of claim 7 wherein presenting information to the player by the game transaction module that is unrelated to the game which the game module is presenting to the player includes presenting information related to at least one of a game or a sports event that is different from the game being presented to the player by the game module.

11. The method of claim 9 wherein presenting information related to at least one of a game or a sports event that is different from the game being presented to the player by the game module includes presenting an opportunity to wager of the game or the sports event via the game transaction module.

12. The method of claim 1, further comprising:

presenting a game to a player by the game module; and presenting player information by the game transaction module that is specific to the player playing the game.

* * * * *